United States Patent [19]

Unger

[11] Patent Number: 4,922,577

[45] Date of Patent: May 8, 1990

[54] EXTENSIBLE HANDLE BAR

[76] Inventor: Henry M. Unger, 24, Sunset Dr., Weston, Conn. 06880

[21] Appl. No.: 305,323

[22] Filed: Feb. 2, 1989

[30] Foreign Application Priority Data

Nov. 12, 1988 [DE] Fed. Rep. of Germany ... 8814209[U]

[51] Int. Cl.[5] ..... B25G 1/04

[52] U.S. Cl. ..... 16/115

[58] Field of Search ..... 16/115, DIG. 25, DIG. 41; 403/109, 334, 343

[56] References Cited

U.S. PATENT DOCUMENTS

| | | | |
|---|---|---|---|
| 3,380,097 | 4/1968 | Pharris | 16/115 X |
| 3,722,903 | 3/1973 | Jones | 16/115 X |
| 4,461,057 | 7/1984 | Unger | 16/115 X |
| 4,715,089 | 12/1987 | Schema | 16/115 |

FOREIGN PATENT DOCUMENTS

| | | |
|---|---|---|
| 1894410 | 6/1964 | Fed. Rep. of Germany . |
| 2448877 | 4/1976 | Fed. Rep. of Germany . |
| 3122103 | 12/1982 | Fed. Rep. of Germany . |
| 3317270 | 11/1983 | Fed. Rep. of Germany . |
| 8524050 | 8/1985 | Fed. Rep. of Germany . |

*Primary Examiner*—Nicholas P. Godici
*Assistant Examiner*—Carmine Cuda
*Attorney, Agent, or Firm*—John C. Smith, Jr.

[57] ABSTRACT

An extensible handle bar for tools has on its outer tube a sleeve-shaped body made of thermoplastic material and provided with an external thread. The body has an extension provided with longitudinally extending slots and an external taper. A sleeve-shaped threaded nut is guided on the external thread of the body and has an internal taper which cooperates with the external taper of the extension. For improving the clamping of the inner tube of the handle bar in the sleeve-shaped body, the angle of inclination of the internal taper of the sleeve-shaped threaded nut is smaller than the angle of inclination of the external taper of the extension of the body provided with an external thread.

3 Claims, 2 Drawing Sheets

EXTENSIBLE HANDLE BAR

BACKGROUND OF THE INVENTION

This invention relates to an extensible handle bar for tools which comprises two telescoped tubes. On the outer tube, a sleeve-shaped body consisting of thermoplastic material and being provided with an external thread is firmly mounted, a said body having an extension provided with longitudinally extending slots and an external taper and extending beyond the trailing end of the outer tube, a sleeve-shaped threaded nut being guided on the body and being provided with an internal taper cooperating with the external taper of the body for the purpose of clamping the inner tube of the handle bar.

Such handle bars are know and are, for example, used for cleaning tools as brushes, sponges or the like or for tools for applying for instance paint, in order to be able to perform cleaning or painting work located at high levels from the ground or floor.

In the known handle bars, however, a safe connection of the two tubes of the handle bar is not guaranteed, as practice has shown.

There is already known an extensible handle bar (German Offenlegungsschrift No. 31 22 103) in which the body, provided with an external thread, comprises at its circumference a plurality of radially arranged extensions having the shape of longitudinal arms, being prestressed and comprising at the back sides of their free ends thickened portions with which the arms pass through cutouts in the wall of the tube carrying the body. The sleeve-shaped threaded nut which is guided on the external thread of the body forms an internal taper adjacent to its thread by means of which the thickened portions of the arms of the body are radially pressed against the wall of the inner tube when the threaded nut is screwed unto the body provided with an external thread. This clamping of the inner tube is, however, not sufficient, as practice has shown, in order to avoid an unintended shifting of the inner tube. Furthermore, it is rendered difficult to exchange the body provided with an external thread in the case of wear, for example, because the resilient arms of the body must be disengaged from the cutouts in the wall of the tube, which is possible only by means of a suitable tool. Such a tool, however, is in most cases not readily available for the user of the handle bar.

There is further known an extensible handle bar (German Offenlegungsschrift No. 33 17 270) in which an annular wedge-type sleeve is clampable between the sleeve-shaped body provided with external threads and mounted on the outer tube and the inner tube. By tightening the sleeve-shaped threaded nut guided on the body provided with external threads, the wedge-type sleeve is moved, for the purpose of clamping the inner tube, into the space between said inner tube and the body provided with external threads or, in the inverse case, moved out of the space between the body provided with external threads and the inner tube for the purposes of loosening said inner tube. Besides the fact that this arrangement needs a further element, i.e. the wedge-type sleeve, in addition to the body provided with external threads and the sleeve-shaped threaded nut, also in this clamping arrangement the clamping of the inner tube is effected in an unsufficient manner by means of a wedge-shaped surface.

SUMMARY OF THE INVENTION

It is, therefore, the object of the present invention to avoid the above-mentioned disadvantages and to provide a clamping arrangement by means of which the inner tube of the handle bar is able to be safely clamped in the adjusted position.

To attain this object, the present invention provides an extensible handle bar for tools comprising an inner cylindrical walled tube and an outer cylindrical walled tube, said inner tube slidably telescoping within said outer tube; a sleeve-shaped body which is firmly mounted on said outer tube, consists of thermoplastic material and is provided with an external thread, said body having an extension provided with longitudinally extending slots and an external taper and extending beyond the trailing end of the outer tube; a sleeve-shaped threaded nut which is guided on the external thread of the sleeve-shaped body and which is provided with an internal taper cooperating with said external taper for the purpose of clamping the inner tube of the handle bar, the internal taper of the sleeve-shaped threaded nut having an angle of inclination which is smaller than the angle of inclination of the external taper of the extension of the body provided with an external thread.

Due to the differently sized angles of inclination of the two tapers, in a very simple manner the inner tube of the handle bar is safely clamped in the adjusted position due to the resilient deformation of the conical extension of the sleeve-shaped body consisting of thermoplastic material.

In a further advantageous development of the handle bar, the body provided with an external thread has projections at its inner circumference by means of which it engages cutouts provided in the wall of the outer tube, said body further having a longitudinal slot corresponding with a longitudinal slot of the extension of the sleeve-shaped body.

The body provided with an external thread is not only safely clampable on the outer tube of the handle bar by means of the projections but can also be pulled off from the outer tube without any efforts by widening the corresponding longitudinal slots.

BRIEF DESCRIPTION OF THE DRAWINGS

An embodiment of the invention will now be described by way of example and with reference to the accompanying drawings in which.

DESCRIPTION OF THE PREFERRED EMBODIMENT

Figure 1:
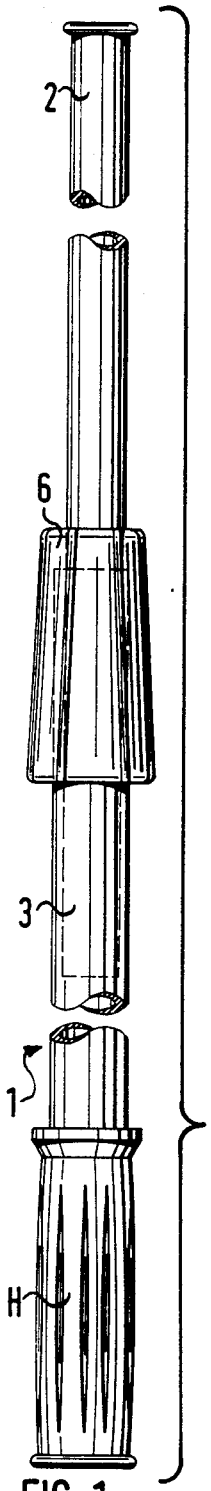
FIG. 1 is an elevational view of two tubes of a partially illustrated handle bar according to the invention with a released threaded nut.
Figure 2:
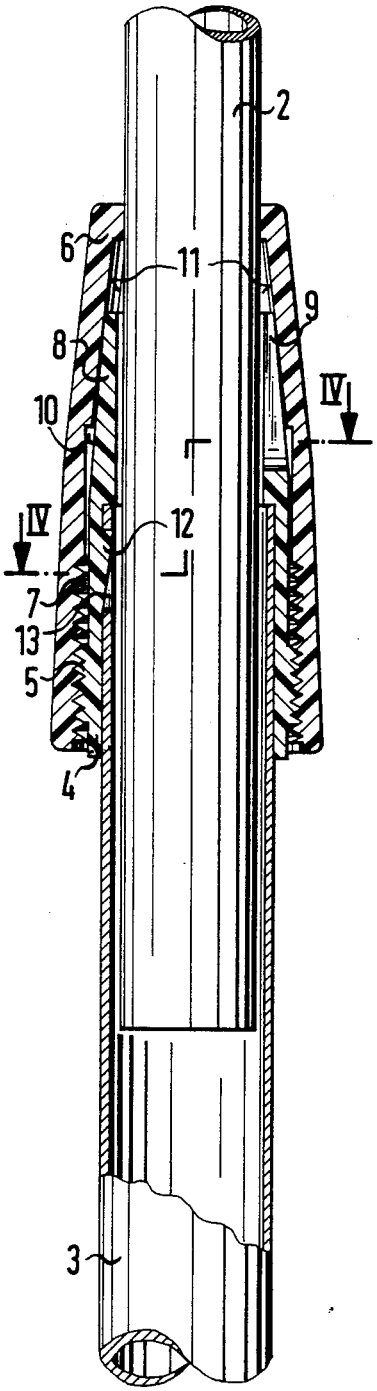
FIG. 2 is a longitudinal section of the two tubes with a partly tightened threaded nut.
Figure 3:
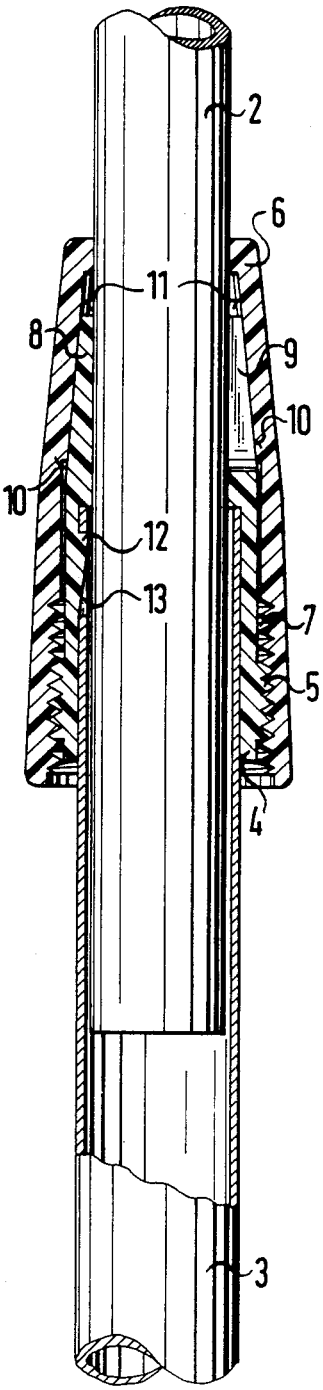
FIG. 3 is a longitudinal section of the two tubes with a firmly tightened threaded nut.
Figure 4:
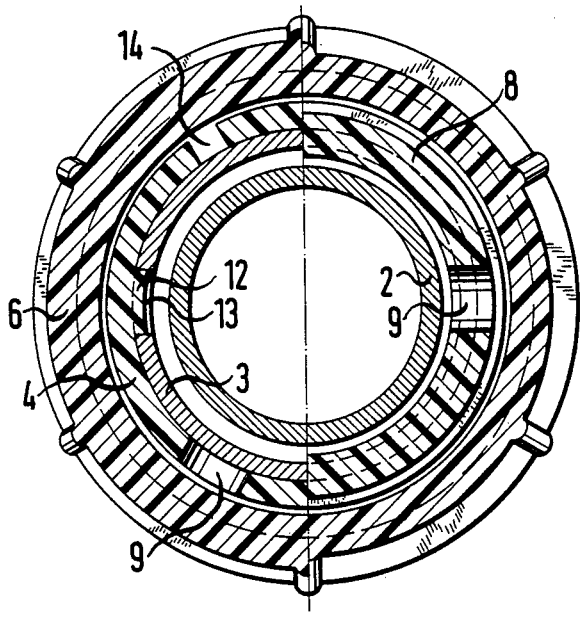
FIG. 4 is a sectional view along the line IV—IV of FIG. 2.

FIGS. 1 to 3 show an extensible handle bar 1 consisting of two tubes 2 and 3 which are slidably inserted into one another. The handle bar 1 is provided with a handle H which is firmly pushed unto the trailing end of the tube 3 and consists of rubber or thermoplastic material. On the tube 3 there is arranged, at its leading end, a sleeve-shaped body 4 consisting of thermoplastic material and being provided over a part of its length with an external thread 5. On the external thread 5 there is guided a threaded nut 6 having an internal thread 7. The sleeve-shaped body 4 possesses an extension 8 which is integral with said body 4, projects beyond the leading end of the outer tube 3 and is provided with longitudinal slots 9. The outer surface of the extension 8 forms an external taper 10. The threaded nut 6 further has an internal taper 11. The angle of inclination of the internal taper 11 is smaller than the angle of inclination of the external taper 10 of the threaded nut 6. When tightening the threaded nut 6, the extension 8 of the body 4 clamps together with the threaded nut 6 and forms a safe connection of the two tubes 2 and 3 to the handle bar 1 (FIGS. 2 and 3).

The sleeve-shaped body 4 comprises at its inner circumference projections 12 which are formed integral therewith by means of which projections it engages, when being pushed unto the tube 3, cutouts 13 in the wall of the tube 3. The body 4 is then reliably mounted on the tube 2. The body 4 further comprises a longitudinal slot 14 corresponding with one of the longitudinal slots 9 of the extension 8. In order to remove the body 4 from the tube 3 without any efforts, if required, the longitudinal slot 14 of the body 4 and the longitudinal slot 9 of the extension 8 corresponding with the slot 14 is only to be widened after loosening the threaded nut 6 from the body 4, thereafter, the body 4 being able to be pulled off from the tube 3.

The invention may be embodied in other specific forms without departing from the spirit or essential characteristics thereof. The embodiment is therefore to be considered in all respects as illustrative and not restrictive.

What is claimed is:

1. An extensible handle bar for tools comprising:

(a) an inner cylindrical walled tube and an outer cylindrical walled tube, the outside diameter of said inner tube being smaller than the interior diameter of said outer tube and being slidably telescoping within said outer tube;

(b) a cylindrical sleeve-shaped body comprising a resilient material and having one end thereof firmly mounted on one end of said outer tube, the cylindrical surface adjacent said one end of said sleeve-shaped body being provided with an external helical thread; an extension, comprising a substantial portion of said sleeve-shaped body opposite said one end thereof, extending beyond said one end of said outer tube and having a plurality of spaced longitudinally extending slots therein extending from the end of said sleeve-shaped body opposite said one end thereof to a position adjacent said one end of said outer tube, the exterior cylindrical surface of said sleeve-shaped body between said opposite end thereof and said position adjacent said one end of said outer tube having an external taper; and (c) a cylindrical sleeve-shaped internal helical threaded nut surrounding said sleeve-shaped body and being guided on said external helical thread of said sleeve-shaped body to move said sleeve-shaped nut axially between unlocked and locked positions, substantially the entire portion of said sleeve-shaped nut extending over said extension of said sleeve-shaped body having an internal taper cooperating with said external taper of said extension, the longitudinal length of the surface of said internal taper being at least the longitudinal length of said external taper;

(d) the angle of inclination of said internal taper of said sleeve-shaped nut being less than the angle of inclination of said external taper of said extension of said sleeve-shaped body when said nut is in unlocked position such that, as said sleeve-shaped nut is screwed on said sleeve-shaped body to move said sleeve-shaped nut from unlocked position to locked position, the internal taper portion of said sleeve-shaped nut surrounding said extension of said sleeve-shaped body first contacts and compresses the portion of said external taper at said opposite end of said sleeve-shaped body and progressively compresses substantially the entire portion of said extension of said sleeve-shaped body between said opposite end of said sleeve-shaped body and said position adjacent said one end of said outer tube against the exterior surface of said inner cylindrical walled tube, and the surface of said internal taper of said sleeve-shaped nut engages the surface of said external taper of said extension of said sleeve-shaped body along substantially said entire surfaces thereof to securely lock said inner and outer tubes relative to each other.

2. An extensible handle bar as defined in claim 1 wherein one of said spaced longitudinally extending slots in said extension of said cylindrical sleeve-shaped body extends longitudinally through said cylindrical sleeve-shaped body to said one end thereof, forming a slot extending the entire length of said cylindrical-shaped body which may be widened to mount or remove said cylindrical sleeve-shaped body to or from said one end of said outer tube.

3. An extensible handle bar as defined in claim 2 wherein:

(a) said outer tube has at least one aperture therein adjacent to but spaced from said one end of said outer tube; and (b) the interior surface of said cylindrical sleeve-shaped body has at least one projection adjacent said one end thereof extending into said at least one aperture in said outer tube;

(c) whereby said cylindrical sleeve-shaped body is locked in place on said one end of said outer tube when said cylindrical sleeve-shaped threaded nut surrounds said sleeve-shaped body.

* * * * *